US011624244B2

(12) United States Patent
Feng et al.

(10) Patent No.: US 11,624,244 B2
(45) Date of Patent: Apr. 11, 2023

(54) CONNECTING STRUCTURE FOR DRILL COLLAR OF LOGGING WHILE DRILLING INSTRUMENT AND DRILL COLLAR SUB MALE AND FEMALE JOINTS

(71) Applicant: CHINA OILFIELD SERVICES, LIMITED, Tianjin (CN)

(72) Inventors: Yongren Feng, Sanhe Langfang (CN); Zhongli Bao, Sanhe Langfang (CN); Qiang Yu, Sanhe Langfang (CN); Xiaofei Qin, Sanhe Langfang (CN); Lin Huang, Sanhe Langfang (CN); Xingfang Wu, Sanhe Langfang (CN); Yuqing Yang, Sanhe Langfang (CN); Jibin Zou, Sanhe Langfang (CN)

(73) Assignee: CHINA OILFIELD SERVICES, LIMITED, Tianjin (CN)

( * ) Notice: Subject to any disclaimer, the term of this patent is extended or adjusted under 35 U.S.C. 154(b) by 611 days.

(21) Appl. No.: 16/627,334

(22) PCT Filed: Apr. 2, 2019

(86) PCT No.: PCT/CN2019/080953
§ 371 (c)(1),
(2) Date: Dec. 30, 2019

(87) PCT Pub. No.: WO2020/168618
PCT Pub. Date: Aug. 27, 2020

(65) Prior Publication Data

US 2021/0277723 A1 Sep. 9, 2021

(30) Foreign Application Priority Data

Feb. 19, 2019 (CN) ..... 201910122743.9

(51) Int. Cl.
*H01R 13/52* (2006.01)
*E21B 17/02* (2006.01)
(Continued)

(52) U.S. Cl.
CPC ..... *E21B 17/028* (2013.01); *H01R 13/5202* (2013.01); *H01R 24/38* (2013.01); *H01R 39/64* (2013.01); *H01R 2201/14* (2013.01)

(58) Field of Classification Search
CPC .... H01R 13/5202; H01R 24/38; H01R 39/64; H01R 2201/14
(Continued)

(56) References Cited

U.S. PATENT DOCUMENTS 5,820,416 A 10/1998 Carmichael
8,636,549 B2 * 1/2014 Pratt ..... H01R 24/58 439/668
(Continued)

FOREIGN PATENT DOCUMENTS

CN 201007205 Y 1/2008
CN 201845972 U 5/2011
(Continued)

OTHER PUBLICATIONS

Office Action dated Jun. 4, 2020 for Chinese Patent Application No. 201910122743.9 and English Translation.
(Continued)

*Primary Examiner* — William H. Mayo, III
(74) *Attorney, Agent, or Firm* — Ling Wu; Stephen Yang; Ling and Yang Intellectual Property

(57) ABSTRACT

A connecting structure for a drill collar of a logging while drilling instrument and drill collar sub male and female joints are provided. The connecting structure for a drill collar of a logging while drilling instrument includes a male connecting joint and a female connecting joint matched with
(Continued)

each other. The male connecting joint and the female connecting joint are rotatable relative to each other. Electrical passages are respectively arranged in the male and female connecting joints. One of the male and female connecting joints is provided with a multi-core coaxial electrical male connector connected with the electrical passage, and the other is correspondingly provided with a multi-core coaxial electrical female connector connected with the electrical passage. The male connecting joint is coaxially nested in the female connecting joint. The multi-core coaxial electrical male connector is inserted into and fitted to the multi-core coaxial electrical female connector.

13 Claims, 3 Drawing Sheets

(51) Int. Cl.
*H01R 24/38* (2011.01)
*H01R 39/64* (2006.01)

(58) Field of Classification Search
USPC ..... 174/74 R, 78, 84 R, 88
See application file for complete search history.

(56) References Cited

U.S. PATENT DOCUMENTS

| | | | | |
|---|---|---|---|---|
| 2005/0070141 | A1* | 3/2005 | Dopf | E21B 17/028 439/140 |
| 2013/0157515 | A1 | 6/2013 | Pratt et al. | |
| 2017/0117677 | A1 | 4/2017 | Pratt | |
| 2019/0003265 | A1 | 1/2019 | McLaughlin | |

FOREIGN PATENT DOCUMENTS

| | | | |
|---|---|---|---|
| CN | 202039843 | U | 11/2011 |
| CN | 102593641 | A | 7/2012 |
| CN | 103151666 | A | 6/2013 |
| CN | 103321584 | A | 9/2013 |
| CN | 104638416 | A | 5/2015 |
| CN | 105134095 | A | 12/2015 |
| CN | 206931743 | U | 1/2018 |
| CN | 207021603 | U | 2/2018 |
| CN | 108071351 | A | 5/2018 |
| CN | 108119127 | A | 6/2018 |
| WO | WO2014185958 | A1 | 11/2014 |

OTHER PUBLICATIONS

Office Action dated Nov. 6, 2019 for Chinese Patent Application No. 201910122743.9 and English Translation.

* cited by examiner

CONNECTING STRUCTURE FOR DRILL COLLAR OF LOGGING WHILE DRILLING INSTRUMENT AND DRILL COLLAR SUB MALE AND FEMALE JOINTS

CROSS-REFERENCE TO RELATED APPLICATIONS

The present application is a U.S. National Phase Entry of International PCT Application No. PCT/CN2019/080953 having an international filing date of Apr. 2, 2019, which claims priority to Chinese patent application No. 201910122743.9 filed to the CNIPA on Feb. 19, 2019. The present application claims priority and the benefit of the above-identified applications and the above-identified applications are incorporated by reference herein in their entirety.

TECHNICAL FIELD

The present disclosure relates to, but is not limited to, the technical field of electrical connection of logging while drilling instruments, in particular to a connecting structure for drill collars of logging while drilling instruments and drill collar sub male and female joints.

BACKGROUND

In the research and development of the logging while drilling instruments (for formation pressure measurement and sampling while drilling), a drill collar connector is required to establish electrical connection and liquid connection between two drill collar subs. There are generally two ways to realize the electrical connection. One way is to install plug and socket respectively in the centers of the connecting parts of the two instruments. The other way is to install a conductive ring on the stepped surface of the drill collar at which the male and female joints are butted. As for the above two types of connection, the conductive slip ring is directly installed on and integrated with the drill collar connector, thereby the volume of the drill collar connector is relatively large, and it is difficult to replace the conductive slip ring.

SUMMARY

The following is an overview of the subject matters described in detail in this disclosure. This summary is not intended to limit the scope of protection of the claims.

The present disclosure provides a connecting structure for a drill collar of a logging while drilling instrument, which includes a male connecting joint and a female connecting joint matched with each other. The male connecting joint and the female connecting joint are rotatable relative to each other. Electrical passages are respectively arranged in the male connecting joint and the female connecting joint. One of the male connecting joint and the female connecting joint is provided with a multi-core coaxial electrical male connector connected with the electrical passage, and the other is correspondingly provided with a multi-core coaxial electrical female connector connected with the electrical passage. The male connecting joint is coaxially nested in the female connecting joint. The multi-core coaxial electrical male connector is inserted into and fitted to the multi-core coaxial electrical female connector.

The present disclosure further provides a drill collar sub male joint, which includes a male joint body provided with an electrical passage therein. An opened groove is arranged at the front end of the male joint body, and a male connecting joint is arranged in the opened groove. A multi-core coaxial electrical female connector connected with the electrical passage is arranged in the male connecting joint.

The present disclosure further provides a drill collar sub female joint, which includes a female joint body provided with an electrical passage therein. An opened groove is arranged at the front end of the female joint body, and a female connecting joint is arranged in the opened groove. A multi-core coaxial electrical male connector connected with the electrical passage is arranged in the female connecting joint.

Other features and advantages of the present disclosure will be set forth in the following description, and partly become apparent from the description, or be understood by implementing the present disclosure. The purposes and other advantages of the present disclosure can be achieved and obtained by means of the structures specifically indicated in the description, claims and drawings.

BRIEF DESCRIPTION OF DRAWINGS

The drawings, provided for further understanding of the technical schemes of the present disclosure and constituting a part of the description, are used for explaining the technical schemes of the present disclosure in combination with the embodiments, and do not limit the technical schemes of the present disclosure.

DETAILED DESCRIPTION

In order to make the objects, technical schemes and advantages of the present disclosure clearer, the embodiments will be described in detail below with reference to the accompanying drawings. It should be noted that the embodiments in the present disclosure and the features in the embodiments can be combined with each other arbitrarily if there is no conflict.

Figure 1:
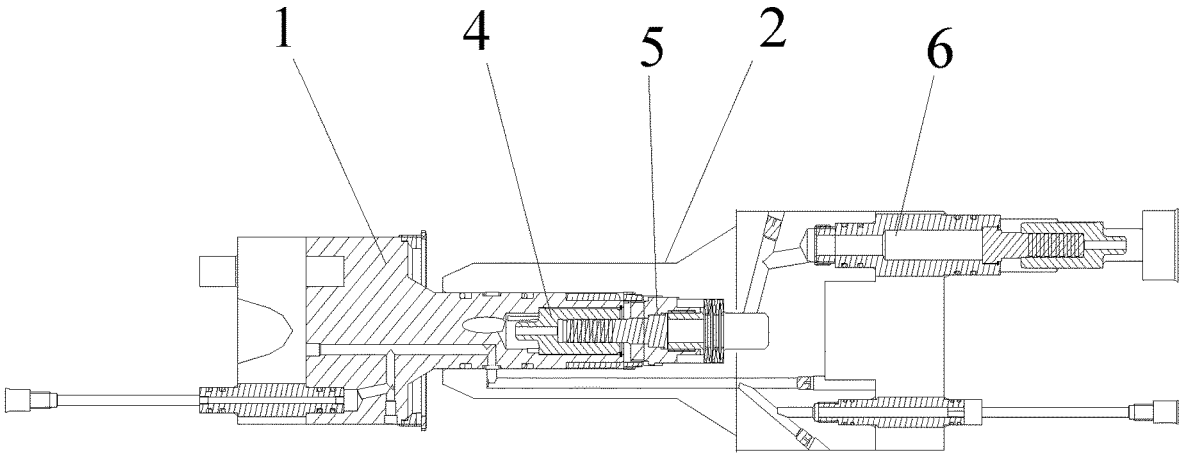
FIG. 1 is a cross-sectional view of a connecting structure for a drill collar of a logging while drilling instrument provided by the present disclosure.
Figure 4:
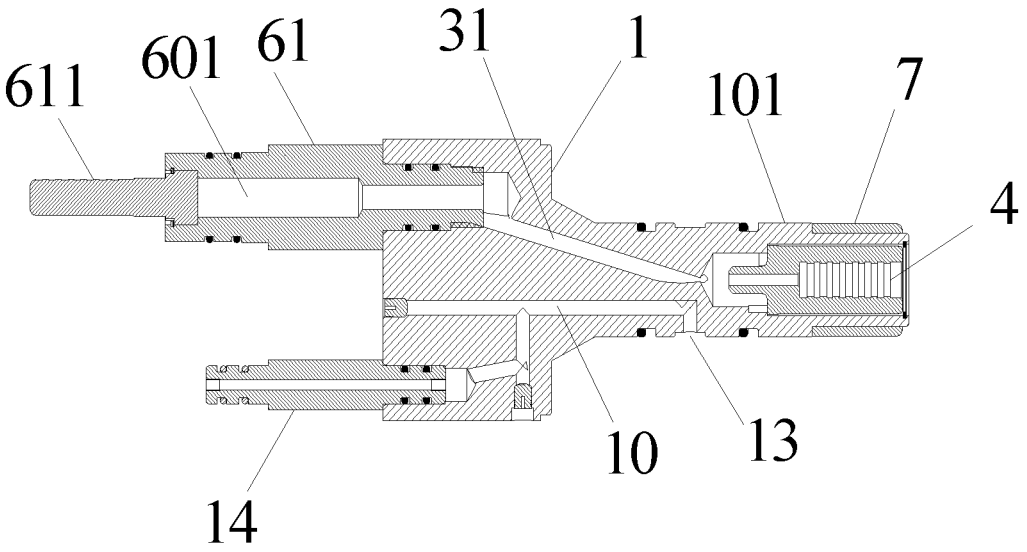
FIG. 4 is a cross-sectional view of a male connecting joint provided by the present disclosure.
Figure 5:
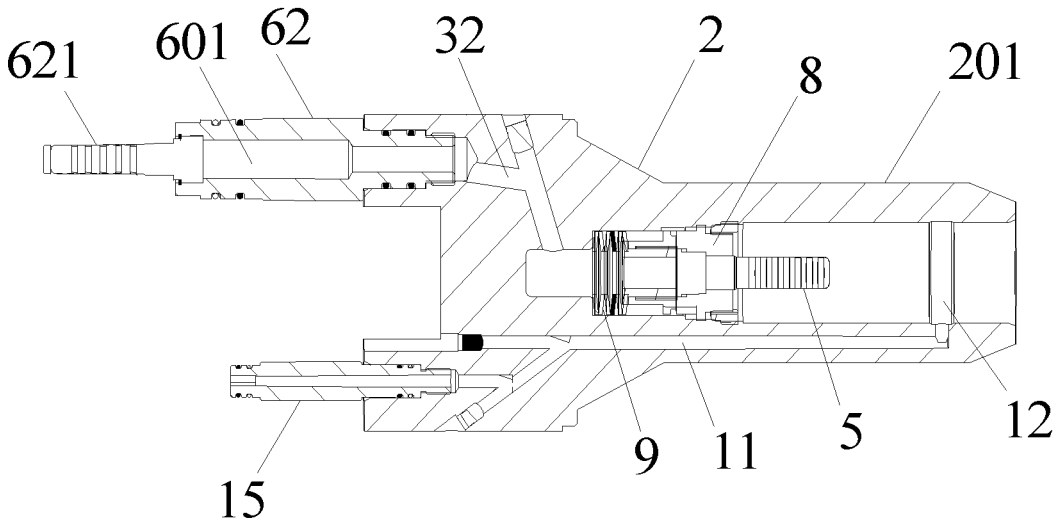
FIG. 5 is a cross-sectional view of a female connecting joint provided by the present disclosure.

As shown in FIGS. 1, 4, and 5, the present disclosure provides a connecting structure for a drill collar of a logging while drilling instrument, which includes a male connecting joint 1 and a female connecting joint 2. The male connecting joint 1 is coaxially nested in the female connecting joint 2, and the male connecting joint 1 and the female connecting joint 2 can rotate relative to each other. An electrical passage 31 is arranged in the male connecting joint 1 and an electrical passage 32 is arranged in the female connecting joint 2. A multi-core coaxial electrical female connector 4 is arranged in the male connecting joint 1, and connected with the electrical passage 31 in the male connecting joint 1. A multi-core coaxial electrical male connector 5 is arranged in the female connecting joint 2, and connected with the electrical passage 32 in the female connecting joint 2. When the male connecting joint 1 is coaxially nested in the female connecting joint 2, the multi-core coaxial electrical male connector 5 is inserted into and fitted to the multi-core coaxial electrical female connector 4, so that the male connecting joint 1 and the female connecting joint 2 are electrically connected. The multi-core coaxial electrical male connector 5 and the multi-core coaxial electrical female connector 4 can be rotated relative to each other for ease of assembly.

In some embodiments, a multi-core coaxial electrical male connector 5 may be provided in the male connecting joint 1, and a multi-core coaxial electrical female connector 4 may be correspondingly provided in the female connecting joint 2.

Figure 2:
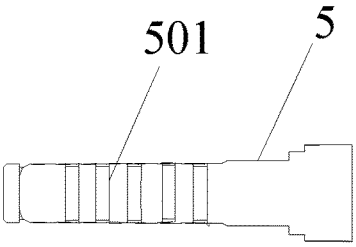
FIG. 2 is a cross-sectional view of a multi-core coaxial electrical male connector in the present disclosure.

As shown in FIG. 2, the multi-core coaxial electrical male connector 5 in this disclosure is of a coaxial design, and its tail part is provided with a lead wire. A plurality of first conductive slip rings 501 are arranged at intervals on the outer wall of the multi-core coaxial electrical male connector 5 and are configured to be connected with the multi-core coaxial electrical female connector 4 to establish electrical connection. There is no need to identify the position in the connection process, the multi-core coaxial electrical female connector 4 and the multi-core coaxial electrical male connector 5 can rotate axially relative to each other.

Figure 3:
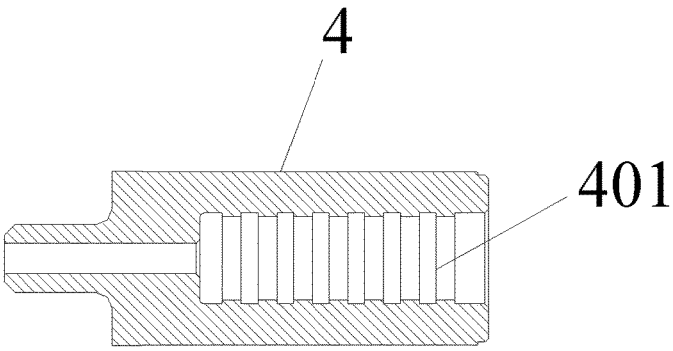
FIG. 3 is a cross-sectional view of a multi-core coaxial electrical female connector in the present disclosure.

As shown in FIG. 3, the multi-core coaxial electrical female connector 4 in this disclosure is of a coaxial design, and its tail part is provided with a lead wire. The multi-core coaxial electrical female connector 4 is provided with a through hole for insertion of the multi-core coaxial electrical male connector 5. A plurality of second conductive slip rings 401 are arranged on the inner wall of the through hole at intervals and are configured to be connected with the multi-core coaxial electrical male connector 5 to establish electrical connection. There is no need to identify the position in the connection process, the multi-core coaxial electrical female connector 4 and the multi-core coaxial electrical male connector 5 can rotate axially relative to each other. When the male connecting joint 1 is coaxially nested in the female connecting joint 2, the multi-core coaxial electrical male connector 5 is inserted into and fitted to the multi-core coaxial electrical female connector 4, so that the first conductive slip rings 501 and the second conductive slip rings 401 are electrically connected to each other, and thus the male connecting joint 1 and the female connecting joint 2 are electrically connected.

In this disclosure, by mating the multi-core coaxial electrical male connector 5 and the multi-core coaxial electrical female connector 4, the electrical connection of the drill collar of the logging while drilling instrument is realized. The conductive slip rings are arranged in the multi-core coaxial electrical male connector 5 and the multi-core coaxial electrical female connector 4, thus the volume and weight of the male connecting joint 1 and the female connecting joint 2 are reduced, and the assembly is easy to carry out with no need for identifying the position by rotation. Additionally, in the present disclosure, by replacing the multi-core coaxial electrical male connector 5 and the multi-core coaxial electrical female connector 4, the number of conductive slip rings can be modified so as to increase or decrease the number of cores for electrical connection. Besides, the multi-core coaxial electrical male connector 5 and the multi-core coaxial electrical female connector 4 can be replaced separately, thereby reducing the maintenance cost.

As shown in FIG. 4, the male connecting joint 1 is provided with a male connector 101. The multi-core coaxial electrical female connector 4 is installed in an opened groove at the front end of the male connector 101. For example, the multi-core coaxial electrical female connector 4 is locked in the opened groove at the front end of the male connector 101 by a snap ring or a lock ring. The male connecting joint 1 is provided at the rear end thereof with an electrical connection pipe 61, and the electrical connection pipe 61 is provided at the rear end thereof with a sub male connector 611 or a sub female connector configured to be connected to an electrical passage in a drill collar sub. In an embodiment, the sub male connector 611 and the sub female connector have the same structures as the above-mentioned multi-core coaxial electrical male connector 5 and multi-core coaxial electrical female connector 4. A through hole 601 communicating with the electrical passage 31 is provided in the electrical connection pipe 61. A sealing ring is provided at the outer wall of the electrical connection pipe 61. The sealing ring has a sealing and isolating function and is configured to isolate the electrical passage 31 from external mud.

As shown in FIG. 4, a sealing surface protection sleeve 7 is arranged on the outer side of the front end of the male connecting joint 1. The sealing surface protection sleeve 7 is made of PEEK engineering plastic with a hardness much smaller than that of metal. The sealing surface protection sleeve 7 is configured to protect the sealing hole of the female connecting joint 2 when connecting the male connecting joint 1 and the female connecting joint 2, so as to avoid the sealing surface being scratched during the connection.

As shown in FIG. 5, the female connecting joint 2 is provided with a female connector 201, and the multi-core coaxial electrical male connector 5 is installed in an opened groove at the front end of the female connector 201. In an embodiment, a mounting sleeve 8 is arranged in the opened groove at the front end of the female connector 201, and the multi-core coaxial electrical male connector 5 is inserted into and held in the mounting sleeve 8. The mounting sleeve 8 is provided with an inner hole, and the inner wall of the inner hole is provided with a keyway structure, so that there is no axial rotation occurred between the multi-core coaxial electrical male connector 5 and the mounting sleeve 8, preventing the wires at the tail part of the multi-core coaxial electrical male connector 5 from being tangled together due to rotation. A positioning key is provided on the outer side of the mounting sleeve 8 to ensure that the mounting sleeve 8 will not rotate within the female connecting joint 2, preventing wires from being intertwined. The mounting sleeve 8 can be displaced along an axis with a maximum displacement distance of 4 mm. The front end of the mounting sleeve 8 is constrained in position by a locking ring, and the rear end of the mounting sleeve 8 is constrained in position by a top ring. The mounting sleeve 8 is interposed between the locking ring and the top ring so as to be axially fixed.

In an embodiment, the male connector 101 is inserted into the opened groove of the female connector 201 to coaxially nest the male connecting joint 1 with the female connecting joint 2.

As shown in FIG. 5, a buffer spring 9 is provided between the female connector 201 and the multi-core coaxial electrical male connector 5. In an embodiment, the buffer spring 9 is a belleville spring and is located between the female connector 201 and the top ring. When the multi-core coaxial electrical male connector 5 is inserted into and fitted to the multi-core coaxial electrical female connector 4, the multi-core coaxial electrical female connector 4 pushes the mounting sleeve 8 and the multi-core coaxial electrical male connector 5 to move, simultaneously compresses the buffer spring 9 which in turn applies an axial force to the multi-core coaxial electrical male connector 5, thereby ensuring reliable electrical connection.

As shown in FIG. 5, the female connecting joint 2 is provided at the rear end thereof with an electrical connection pipe 62, and the electrical connection pipe 62 is provided at the rear end thereof with a sub male connector 621 or a sub female connector configured to be connected to an electrical passage in a drill collar sub. In an embodiment, the structures of the sub male connector 621 and the sub female connector are the same as that of the above-mentioned multi-core coaxial electrical male connector 5 and multi-core coaxial electrical female connector 4. A through hole 601 communicating with the electrical passage 32 is provided in the electrical connection pipe 62. A sealing ring is provided at the outer wall of the electrical connection pipe 62. The sealing ring has a sealing and isolating function and is configured to isolate the electrical passage 32 from external mud.

As shown in FIGS. 4 and 5, the male connecting joint 1 and the female connecting joint 2 are respectively provided with liquid passages 10 and 11 which are passageways through which liquid flows in the male connecting joint 1 and the female connecting joint 2. In this embodiment, the liquid is the fluid inside the formation.

As shown in FIGS. 4 and 5, the male connecting joint 1 is provided in the outer wall thereof with a first annular connecting groove 13 which communicates with the liquid passage 10 in the male connecting joint 1. The female connecting joint 2 is correspondingly provided in the inner wall thereof with a second annular connecting groove 12 which communicates with the liquid passage 11 in the female connecting joint 2. When the male connecting joint 1 is inserted into and fitted to the female connecting joint 2, the first annular connecting groove 13 and the second annular connecting groove 12 are connected to each other to form a closed annular passage which communicates the liquid passage 10 in the male connecting joint 1 with the liquid passage 11 in the female connecting joint 2, so that the male connecting joint 1 and the female connecting joint 2 can rotate relative to each other without affecting the liquid communication.

As shown in FIGS. 4 and 5, the male connecting joint 1 and the female connecting joint 2 are respectively provided at their rear ends with liquid connection pipes 14 and 15 which communicate with the liquid passages 10 and 11. The liquid connection pipes 14 and 15 connect the liquid passages 10 and 11 in the male connecting joint 1 and the female connecting joint 2 to the inside of the drill collar subs.

Figure 6:
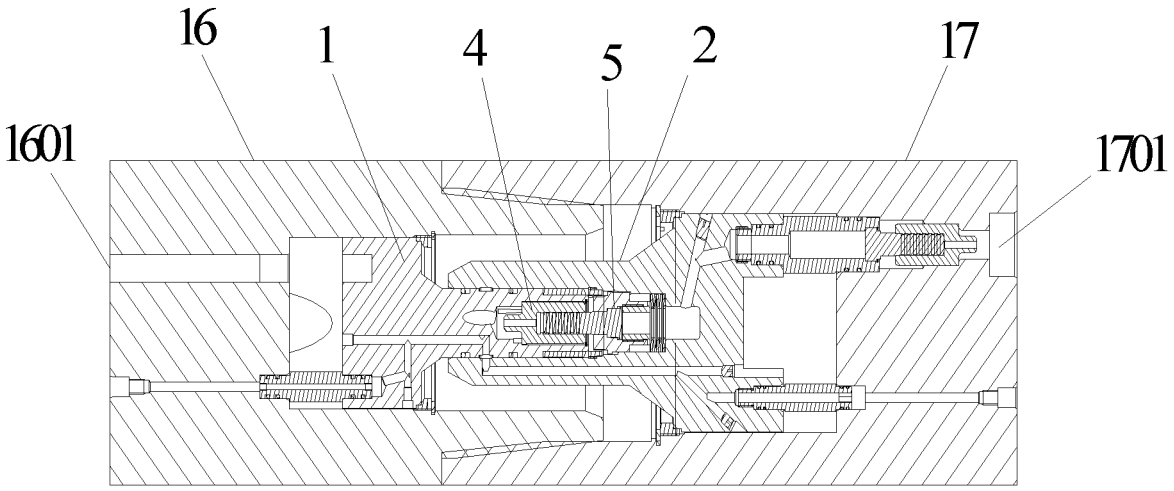
FIG. 6 is a schematic structural view of a drill collar sub male joint and a drill collar sub female joint provided by the present disclosure.

As shown in FIG. 6, the drill collar of the logging while drilling instrument includes a drill collar sub male joint and a drill collar sub female joint which are matched with each other. The drill collar sub male joint includes a male joint body 16 in which an electrical passage 1601 is arranged. An opened groove is arranged at the front end of the male joint body 16, and a male connecting joint 1 is arranged in the opened groove. A multi-core coaxial electrical female connector 4 connected with the electrical passage 1601 is arranged in the male connecting joint 1. The drill collar sub female joint includes a female joint body 17 in which an electrical passage 1701 is arranged. An opened groove is arranged at the front end of the female joint body 17, and a female connecting joint 2 is arranged in the opened groove. A multi-core coaxial electrical male connector 5 connected with the electrical passage 1701 is arranged in the female connecting joint 2. When the male joint body 16 is inserted into and fitted to the female joint body 17, the male connecting joint 1 is coaxially nested in the female connecting joint 2, so that the electrical connection between the drill collar sub male joint and the drill collar sub female joint is realized.

In an embodiment, the male connecting joint 1 and the female connecting joint 2 are respectively provided at their outer sides with grooves for the passage of mud, ensuring that the mud passes through the drill collar sub male and female joints smoothly.

Optionally, a plurality of first conductive slip rings are provided at an outer wall of the multi-core coaxial electrical male connector at intervals, and a plurality of second conductive slip rings are correspondingly provided at an inner wall of the multi-core coaxial electrical female connector, and the multi-core coaxial electrical male connector is inserted into and fitted to the multi-core coaxial electrical female connector so as to electrically connect the first conductive slip rings with the second conductive slip rings.

Optionally, electrical connection pipes connected with the electrical passages are respectively provided at the rear ends of the male connecting joint and the female connecting joint, and a sub male connector or sub female connector is provided at the rear end of the electrical connection pipe.

Optionally, a sealing ring is provided at the outer wall of the electrical connection pipe.

Optionally, grooves are respectively provided at the outer sides of the male connecting joint and the female connecting joint for the passage of mud.

Optionally, liquid passages are respectively arranged in the male connecting joint and the female connecting joint, a first annular connecting groove communicated with the liquid passage being provided in the outer wall of the male connecting joint, a second annular groove communicated with the liquid passage being provided in the inner wall of the female connecting joint, the male connecting joint is coaxially nested in the female connecting joint, so that the first annular connecting groove is connected with the second annular connecting groove.

Optionally, liquid connection pipes communicated with the liquid passages are respectively provided at the rear ends of the male connecting joint and the female connecting joint.

Optionally, a sealing surface protection sleeve is sleeved on the outer side of the front end of the male connecting joint.

Optionally, the female connecting joint is provided with a female connector and the male connecting joint is provided with a male connector, the multi-core coaxial electrical male connector being installed in an opened groove at the front end of the female connector, the multi-core coaxial electrical female connector being installed in an opened groove at the front end of the male connector, the male connector being inserted into the opened groove of the female connector to realize coaxial nesting of the male connecting joint and the female connecting joint.

Optionally, a mounting sleeve is arranged in the female connecting joint, and the multi-core coaxial electrical male connector is inserted into the mounting sleeve.

Optionally, a buffer spring is arranged between the female connector and the multi-core coaxial electrical male connector.

In the present disclosure, by matching the multi-core coaxial electrical male connector with the multi-core coaxial electrical female connector, the electrical connection of the drill collar of the logging while drilling instrument is achieved. Furthermore, the multi-core coaxial electrical male connector and the multi-core coaxial electrical female connector can rotate relative to each other without affecting the electrical connection.

In the present disclosure, by arranging the conductive slip rings on the multi-core coaxial electrical male connector and the multi-core coaxial electrical female connector, the volume and weight of the male connecting joint and the female connecting joint are reduced. Also, the assembly is facilitated and there is no need to identify the position by rotation.

In the present disclosure, by replacing the multi-core coaxial electrical male connector and the multi-core coaxial electrical female connector, the number of conductive slip rings can be changed and the number of electrically connected cores can be increased or decreased. Besides, the multi-core coaxial electrical male connector and the multi-core coaxial electrical female connector can be separately replaced, thereby reducing the maintenance cost.

In the present disclosure, by connecting the first annular connecting groove and the second annular connecting groove, the communication between the liquid passages is realized, so that the male connecting joint and the female connecting joint can rotate relative to each other without affecting the liquid communication.

While the embodiments of the present disclosure are described above, the above embodiments are merely described for ease of understanding the present disclosure, and are not intended to limit the present disclosure. Any modifications and variations can be made, in the forms and details, to the embodiments by a person skilled in the art to which the present disclosure pertains without departing from the spirit and scope of the present disclosure. The patent protection scope of the present disclosure shall be defined by the appended claims.

What we claim is:

1. A connecting structure for a drill collar of a logging while drilling instrument, comprising a male connecting joint and a female connecting joint matched with each other, the male connecting joint and the female connecting joint being rotatable relative to each other, electrical passages being respectively arranged in the male connecting joint and the female connecting joint, one of the male connecting joint and the female connecting joint being provided with a multi-core coaxial electrical male connector connected with the corresponding electrical passage, the other being correspondingly provided with a multi-core coaxial electrical female connector connected with the corresponding electrical passage, wherein when the male connecting joint is coaxially nested in the female connecting joint, the multi-core coaxial electrical male connector is inserted into and fitted to the multi-core coaxial electrical female connector, so that the male connecting joint and the female connecting joint are electrically connected.

2. The connecting structure for a drill collar of a logging while drilling instrument according to claim 1, wherein a plurality of first conductive slip rings are provided at an outer wall of the multi-core coaxial electrical male connector at intervals, and a plurality of second conductive slip rings are correspondingly provided at an inner wall of the multi-core coaxial electrical female connector, and wherein the multi-core coaxial electrical male connector is inserted into and fitted to the multi-core coaxial electrical female connector so as to electrically connect the first conductive slip rings with the second conductive slip rings.

3. The connecting structure for a drill collar of a logging while drilling instrument according to claim 1, wherein electrical connection pipes connected with the electrical passages are respectively provided at rear ends of the male connecting joint and the female connecting joint, and a sub male connector or sub female connector is provided at a rear end of the electrical connection pipe.

4. The connecting structure for a drill collar of a logging while drilling instrument according to claim 3, wherein a sealing ring is provided at an outer wall of the electrical connection pipe.

5. The connecting structure for a drill collar of a logging while drilling instrument according to claim 1, wherein grooves are respectively provided at outer sides of the male connecting joint and the female connecting joint for the passage of mud.

6. The connecting structure for a drill collar of a logging while drilling instrument according to claim 1, wherein liquid passages are respectively arranged in the male connecting joint and the female connecting joint, a first annular connecting groove communicated with the liquid passage being provided in an outer wall of the male connecting joint, a second annular connecting groove communicated with the liquid passage being provided in an inner wall of the female connecting joint, the male connecting joint is coaxially nested in the female connecting joint, so that the first annular connecting groove is connected with the second annular connecting groove.

7. The connecting structure for a drill collar of a logging while drilling instrument according to claim 6, wherein liquid connection pipes communicated with the liquid passages are respectively provided at rear ends of the male connecting joint and the female connecting joint.

8. The connecting structure for a drill collar of a logging while drilling instrument according to claim 1, wherein a sealing surface protection sleeve is sleeved on an outer side of a front end of the male connecting joint.

9. The connecting structure for a drill collar of a logging while drilling instrument according to claim 1, wherein the female connecting joint is provided with a female connector and the male connecting joint is provided with a male connector, the multi-core coaxial electrical male connector being installed in an opened groove at the front end of the female connector, the multi-core coaxial electrical female connector being installed in an opened groove at the front end of the male connector, the male connector being inserted into the opened groove of the female connector to realize coaxial nesting of the male connecting joint and the female connecting joint.

10. The connecting structure for a drill collar of a logging while drilling instrument according to claim 9, wherein a mounting sleeve is arranged in the female connecting joint, and the multi-core coaxial electrical male connector is inserted into the mounting sleeve.

11. The connecting structure for a drill collar of a logging while drilling instrument according to claim 9, wherein a buffer spring is arranged between the female connector and the multi-core coaxial electrical male connector.

12. A drill collar sub male joint, comprising a male joint body provided with an electrical passage therein, an opened groove being arranged at a front end of the male joint body, a male connecting joint being arranged in the opened groove, a multi-core coaxial electrical female connector connected with the electrical passage being arranged in the male connecting joint, wherein when the male connecting joint is coaxially nested in a female connecting joint matched with the male connecting joint, a multi-core coaxial electrical male connector of the female connecting joint is inserted into and fitted to the multi-core coaxial electrical female connector, so that the male connecting joint and the female connecting joint are electrically connected.

13. A drill collar sub female joint, comprising a female joint body provided with an electrical passage therein, an opened groove being arranged at a front end of the female joint body, a female connecting joint being arranged in the opened groove, a multi-core coaxial electrical male connector connected with the electrical passage being arranged in the female connecting joint, wherein when a male connecting joint matched with the female connecting joint is coaxially nested in the female connecting joint, the multi-core coaxial electrical male connector is inserted into and fitted to a multi-core coaxial electrical female connector of the male connecting joint, so that the male connecting joint and the female connecting joint are electrically connected.

* * * * *